US011181012B2

(12) United States Patent
Alexandru et al.

(10) Patent No.: US 11,181,012 B2
(45) Date of Patent: Nov. 23, 2021

(54) VALVE ACTUATION SYSTEM COMPRISING TWO ROCKER ARMS AND A COLLAPSING MECHANISM

(71) Applicant: Jacobs Vehicle Systems, Inc., Bloomfield, CT (US)

(72) Inventors: Matei Alexandru, Somers, CT (US); Justin D. Baltrucki, Canton, CT (US); Gabriel S. Roberts, Wallingford, CT (US); John Mandell, Vernon, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 41 days.

(21) Appl. No.: 16/706,701

(22) Filed: Dec. 7, 2019

(65) Prior Publication Data

US 2020/0182097 A1 Jun. 11, 2020

Related U.S. Application Data

(60) Provisional application No. 62/776,935, filed on Dec. 7, 2018.

(51) Int. Cl.
*F01L 1/18* (2006.01)
*F01L 1/24* (2006.01)

(52) U.S. Cl.
CPC ..... *F01L 1/181* (2013.01); *F01L 1/24* (2013.01); *F01L 2001/186* (2013.01)

(58) Field of Classification Search
CPC ..... F01L 1/181; F01L 1/18; F01L 1/46; F01L 1/22; F01L 1/20; F01L 1/24; F01L 2001/186; F02F 1/4214; F02F 2001/245
(Continued)

(56) References Cited

U.S. PATENT DOCUMENTS 4,556,025 A * 12/1985 Morita ..... F01L 13/0005 123/198 F
5,107,803 A * 4/1992 Furnivall ..... F01L 1/181 123/90.16

(Continued)

FOREIGN PATENT DOCUMENTS

DE 10155800 A1 5/2003
JP 59115807 U 8/1984

(Continued)

OTHER PUBLICATIONS

International Search Report for International Application No. PCT/US2019/065113 dated Mar. 24, 2020, 3 pages.

(Continued)

*Primary Examiner* — Devon C Kramer
*Assistant Examiner* — Kelsey L Stanek
(74) *Attorney, Agent, or Firm* — Moreno IP Law LLC

(57) ABSTRACT

A valve actuation system for actuating at least one engine valve comprises a first half-rocker arm configured to receive main valve actuation motions from a main valve actuation motion source and a second rocker arm configured to actuate the at least one engine valve. A collapsing mechanism is also provided and configured relative to the first half-rocker arm and the second rocker arm, in a first collapsing mechanism state, to convey the main valve actuation motions from the first half-rocker arm to the second rocker arm and, in a second collapsing mechanism state, to prevent conveyance of the main valve actuation motions from the first half-rocker arm to the second rocker arm. The collapsing mechanism may be disposed in the first half-rocker arm or the second rocker arm, where the rocker arm not including the collapsing mechanism is provided with a collapsing mechanism contact surface.

15 Claims, 11 Drawing Sheets

(58) Field of Classification Search
USPC ..... 123/90.12, 90.15, 90.16, 90.39, 90.44
See application file for complete search history.

(56) References Cited

U.S. PATENT DOCUMENTS

| | | | | |
|---|---|---|---|---|
| 8,936,006 | B2 | 1/2015 | Groth et al. | |
| 9,790,824 | B2 | 10/2017 | Baltrucki et al. | |
| 2002/0017252 | A1 | 2/2002 | Onoue | |
| 2005/0132990 | A1* | 6/2005 | Haas | F01L 13/0015 123/90.16 |
| 2005/0188930 | A1* | 9/2005 | Best | F01L 1/181 123/90.16 |
| 2005/0274341 | A1 | 12/2005 | Usko et al. | |
| 2012/0024260 | A1* | 2/2012 | Groth | F01L 1/26 123/321 |
| 2013/0306016 | A1* | 11/2013 | Kato | F01L 1/18 123/90.45 |
| 2014/0245992 | A1 | 9/2014 | Groth et al. | |
| 2017/0145876 | A1* | 5/2017 | Pham | F01L 1/181 |
| 2020/0182097 | A1 | 6/2020 | Alexandru et al. | |

FOREIGN PATENT DOCUMENTS

| | | | | | |
|---|---|---|---|---|---|
| JP | S60116808 | A | | 6/1986 | |
| JP | 6175207 | A | | 8/1986 | |
| JP | 61175207 | A | * | 8/1986 | F01L 1/181 |
| JP | 61250317 | A | | 11/1986 | |
| JP | 63100606 | U | | 6/1988 | |
| JP | H06299819 | A | | 10/1994 | |
| JP | H02191805 | A | | 7/1999 | |
| JP | 2013253550 | A | | 12/2013 | |

OTHER PUBLICATIONS

Written Opinion of the ISA for International Application No. PCT/US2019/065113 dated Mar. 24, 2020, 4 pages.
International Search Report for International Application No. PCT/US2019/065112 dated Mar. 24, 2020, 4 pages.
Written Opinion of the ISA for International Application No. PCT/US2019/065112 dated Mar. 24, 2020, 4 pages.

* cited by examiner

VALVE ACTUATION SYSTEM COMPRISING TWO ROCKER ARMS AND A COLLAPSING MECHANISM

CROSS-REFERENCE TO RELATED APPLICATION

The instant application claims the benefit of co-pending Provisional U.S. Patent Application Ser. No. 62/776,935 entitled "VALVE ACTUATION SYSTEM COMPRISING TWO ROCKER ARMS AND A COLLAPSING MECHANISM" and filed Dec. 7, 2018, the teachings of which are incorporated herein by this reference. The instant application is also related to co-pending application entitled "VALVE ACTUATION SYSTEM COMPRISING AT LEAST TWO ROCKER ARMS AND A ONE-WAY COUPLING MECHANISM" having attorney docket number JVSPP090US, filed on even date herewith.

FIELD

The instant disclosure relates generally to valve actuation systems in internal combustion engines and, in particular, to a valve actuation system based on two rocker arms and a collapsing mechanism.

BACKGROUND

Valve actuation systems for use in internal combustion engines are well known in the art. Some valve actuation systems are capable of providing so-called auxiliary valve actuation motions, i.e., valve actuation motions other than or in addition to the valve actuation motions used to operate an engine in a positive power production mode through the combustion of fuel (often referred to as main valve actuation motions). Such auxiliary valve actuation motions include, but are not limited to, compression-release engine braking in which an engine's cylinders are operated in an unfueled stated to essentially act as air compressors, thereby providing vehicle retarding power through the vehicle's drive train. So-called high power density (HPD) compression-release engine braking provides for two compression-release events for each cycle of the engine, which provides increased retarding power as compared to prior art compression-release systems where only a single compression-release event is provided for each cycle of the engine. In such HPD systems, it is necessary to allow the main valve actuation motions to be "lost" (not conveyed to the engine valves) in favor of the auxiliary valve actuation motions that implement the HPD engine braking.

To facilitate loss of the main event motions, HPD valve actuation systems are known to incorporate a collapsing mechanism in a valve bridge, as described in, for example, U.S. Pat. No. 8,936,006 and/or U.S. Patent Application Publication No. 2014/0245992. In these prior art systems, the collapsing mechanism comprises a hydraulically-controlled locking mechanism that, in a mechanically locked state, permits valve actuation motions to be conveyed via the valve bridge and, in a mechanically unlocked state, causes the collapsing mechanism to absorb any applied valve actuation motions thereby preventing their conveyance via the valve bridge.

Furthermore, in order to improve fuel efficiency and reduce tail pipe emission, among other benefits, so-called cylinder deactivation (CDA) is a desirable feature in many internal combustion engines. Collapsing valve bridges may be used for this purpose as well.

However, in some cases, a collapsing mechanism deployed in a valve bridge is not feasible (e.g., due to the lack of sufficient space or use of a guided valve bridge that cannot accommodate a collapsing mechanism) or a valve bridge is not desired. Consequently, valve actuation systems that facilitate the provision of CDA and/or auxiliary valve actuation such as conventional or HPD engine braking would represent a welcome advancement of the art.

SUMMARY

The above-noted shortcomings of prior art solutions are addressed through the provision of a system for actuating at least one engine valve comprising a first half-rocker arm configured to receive main valve actuation motions from a main valve actuation motion source and a second rocker arm configured to actuate the at least one engine valve. A collapsing mechanism is also provided and configured relative to the first half-rocker arm and the second rocker arm, in a first collapsing mechanism state, to convey the main valve actuation motions from the first half-rocker arm to the second rocker arm and, in a second collapsing mechanism state, to prevent conveyance of the main valve actuation motions from the first half-rocker arm to the second rocker arm. The collapsing mechanism may be disposed in the first half-rocker arm or the second rocker arm, where the rocker arm not including the collapsing mechanism is provided with a collapsing mechanism contact surface and, in a further embodiment, the collapsing mechanism may comprise a hydraulically-controlled locking mechanism. The first half-rocker arm may comprise a resilient element contact surface configured to cooperatively engage with a resilient element for biasing the first half-rocker arm into contact with the main valve actuation motion source. Either of the first half-rocker arm or the second rocker arm may comprise a hydraulic lash adjuster. In this case, a travel limiter may also be provided that limits a bias force applied by the collapsing mechanism on the hydraulic lash adjuster.

In one embodiment, the second rocker arm is a second half-rocker arm. In this embodiment, the system may further comprise a resilient element, disposed between the first half-rocker arm and the second rocker arm to bias the first half-rocker arm into contact with the main valve actuation motion source.

In another embodiment, the second rocker arm is additionally configured to receive auxiliary valve actuation motions from an auxiliary valve actuation motion source. In this embodiment, the second rocker arm may comprise a hydraulically-controlled actuator configured relative to the second rocker arm and the at least one engine valve, in a first actuator state, to convey the auxiliary valve actuation motions from the second rocker arm to the at least one engine valve and, in a second actuator state, to prevent conveyance of the auxiliary valve actuation motions from the second rocker arm to the at least one engine valve. Further this embodiment, the main valve actuation motion source may comprise a cam having at least a sub-base circle closing ramp configured to control closing velocity of the at least one engine valve when the collapsing mechanism is operating in the first collapsing mechanism state and the actuator is operating in the first actuator state. Further still, the main valve actuation motion source may comprise a cam having at least a sub-base circle configured to allow extension of the hydraulically-controlled actuator while the collapsing mechanism is in the first collapsing mechanism state such that the second rocker arm simultaneously conveys the main valve actuation motions and the auxiliary valve actuation motions. A system in accordance with this embodiment may further comprise a control system configured to transition the hydraulically-controlled actuator from the second actuator state to the first actuator state prior to transitioning the collapsing mechanism from the first collapsing mechanism state to the second collapsing mechanism state.

BRIEF DESCRIPTION OF THE DRAWINGS

The features described in this disclosure are set forth with particularity in the appended claims. These features and attendant advantages will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 1:
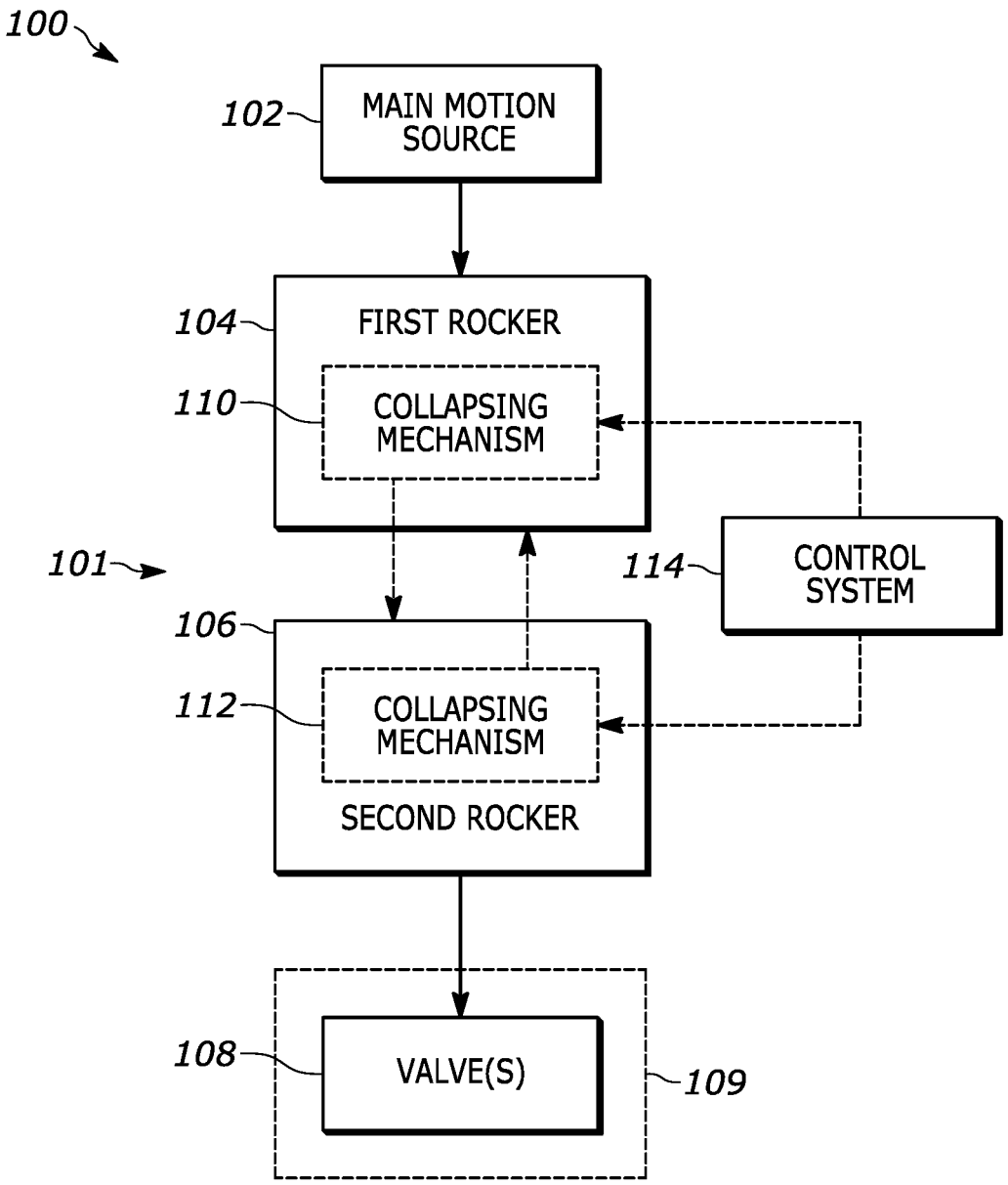
FIG. 1 is a schematic illustration of a valve actuation system in accordance with a first embodiment of the instant disclosure.

FIG. 1 schematically illustrates a valve actuation system 101 comprising a first rocker arm 104 and a second rocker arm 106 that may be selectively coupled together such that valve actuation motions provided by a main valve actuation motion source 102 are conveyed to one or more engine valves 108 (associated with a cylinder 109 of an internal combustion engine 100) via the first and second rockers 104, 106. Alternatively, the first and second rocker arms 104, 106 may be selectively decoupled from each other such that valve actuation motions applied to the first rocker arm 104 are not conveyed to the second rocker arm 106, i.e., the valve actuation motions are lost. As known in the art, the engine valves 108 may comprise intake valves, exhaust valves or auxiliary valves and, in an embodiment, separate valve actuation systems 101 can be separately provided for different engine valve types associated with a single cylinder, e.g., one instance of a valve actuation system 101 for intake valves of a cylinder and another instance of a valve actuation system 101 for exhaust valves of that same cylinder.

As used herein, the term "coupled" refers to sufficient communication between components such that at least a portion of valve actuation motions applied to one of the components are conveyed to the other component without necessarily requiring a fixed or two-way connection, and the term "decoupled" refers to a lack of or insufficient communication between components such that valve actuation motions are not conveyed via those components. Thus, for example, components that simply contact each other may be coupled to the extent that conveyance of valve actuation motions from one component to another is achieved. Alternatively, components that contact each other but that do not result in transmission of valve actuation motions from one component to another (as in the case, for example, of an unlocked locking mechanism as described herein) are decoupled. As yet another alternative, decoupling can result from the establishment of a sufficient amount of clearance or lash space between two components such that all valve actuation motions applied to one of the components are lost prior to transmission to the other component. However, the establishment of lash space between two component that still results in the transmission of some, but not all, applied valve actuation motions are still considered as a coupling between those components.

Regardless, coupling/decoupling of the first and second rocker arms 104, 106 may be achieved through use of collapsing mechanism 110, 112 deployed within either the first or second rocker arm 104, 106 as illustrated. Note that, despite illustrating alternative configurations of the collapsing mechanism 110, 112 in FIG. 1, only a single collapsing mechanism is provided in the system 101. In a presently preferred embodiment, the collapsing mechanism 110 is deployed within the first rocker arm 104. The collapsing mechanism 110, 112 may comprise a hydraulically-actuated locking mechanism of the type described in U.S. Pat. No. 9,790,824, the teachings of which are incorporated herein by this reference (examples of which are illustrated below with reference to FIGS. 4 and 10). Alternatively, rather than relying on a mechanically locking mechanism, the collapsing mechanism could be implemented using a control valve, as known in the art, to create a trapped volume of hydraulic fluid that causes a piston or similar component to be rigidly maintained in an extended position, but that otherwise retracts when the trapped volume of hydraulic fluid is released. Further, those skilled in the art will appreciate that the collapsing mechanism need not be restricted to hydraulically-actuated devices but could instead be implemented pneumatically or electromagnetically.

Regardless of how it is implemented, the collapsing mechanism 110, 112 may be maintained in a first collapsing mechanism state in which the first and second rocker arms 104, 106 are coupled, or in a second collapsing mechanism state in which the first and second rocker arms 104, 106 are decoupled. Because all valve actuation motions are lost when the collapsing mechanism 110, 112 is operated in the second collapsing mechanism state, the cylinder 109 can be maintained in a deactivated state, i.e., incapable of producing positive power.

As further shown in FIG. 1, a control system 114 is provided to control transition of the coupling mechanism 110, 112 from the first collapsing mechanism state to the second collapsing mechanism state and vice versa. For example, where the collapsing mechanism 110, 112 comprises a hydraulically-controlled locking mechanism, the control system 114 may comprise a suitable engine control unit (ECU), as known in the art, in communication with one or more high-speed solenoids, also as known in the art. In this case, the ECU may control a high-speed solenoid to provide hydraulic fluid to, or to restrict flow of hydraulic fluid to, the collapsing mechanism 110, 112, thereby controlling the collapsing mechanism's operating state. To the extent that a given engine 100 may comprise multiple valve actuation systems 101 (corresponding to separate valve types in a single cylinder and/or across multiple cylinders in the engine), the ECU may communicate for this purpose with a single solenoid that controls hydraulic fluid to a plurality of valve actuation system 101, or multiple solenoids that each control individual valve actuation systems 101 or sub-groups of valve actuation systems 101.

Figure 2:
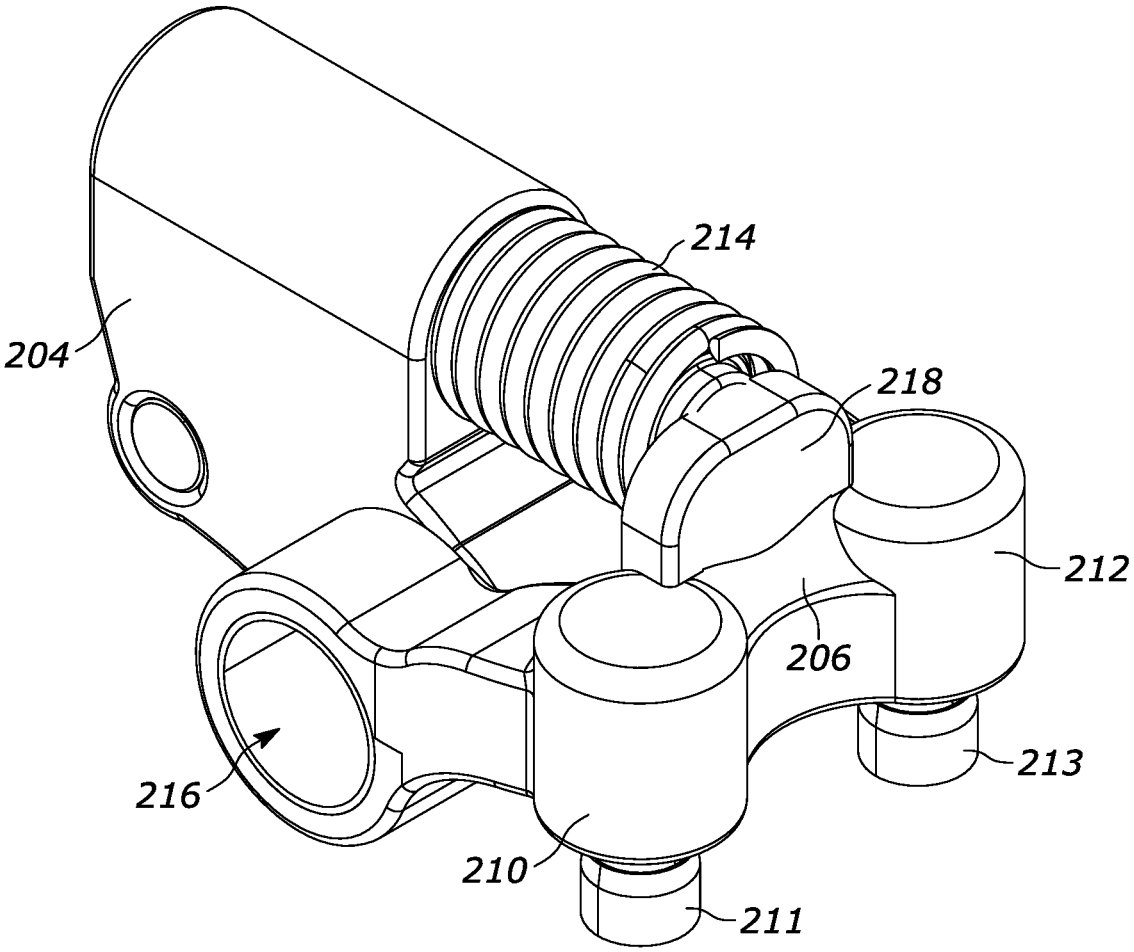
FIGS. 2-4 are respective top isometric, bottom isometric and side cross-sectional views of an example of a valve actuation system in accordance with the embodiment of FIG. 1.
Figure 3:
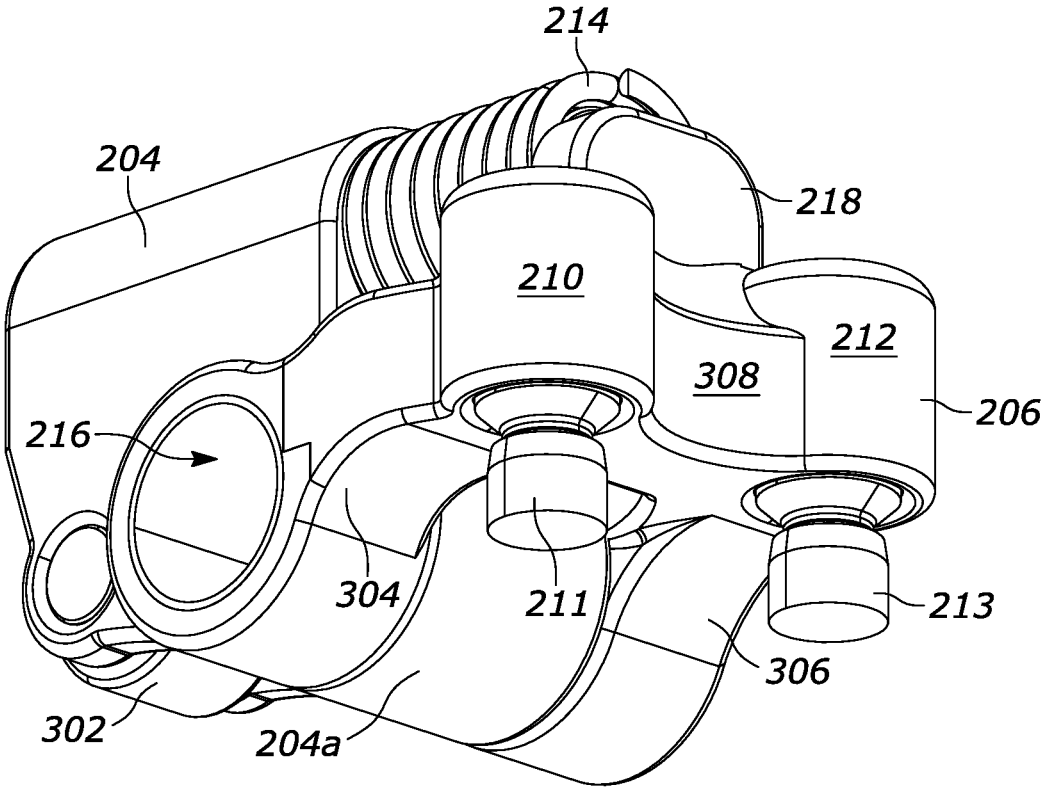
Figure 4:
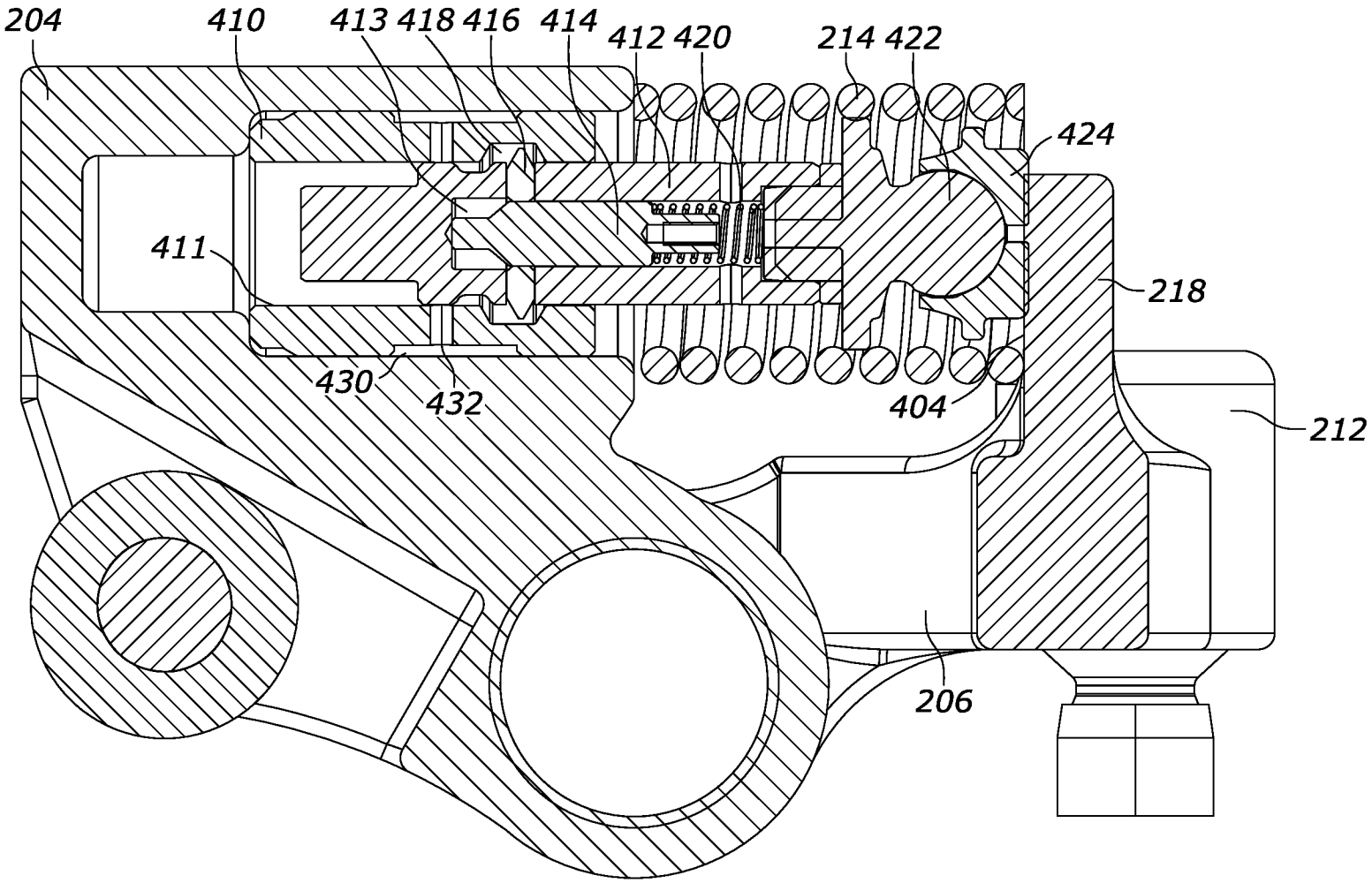

An example of a valve actuation system in accordance with the system 101 illustrated in FIG. 1 is further illustrated with regard to FIGS. 2-4. As shown, in this embodiment, the first and second rocker arms 204, 206 each comprise a half-rocker rotatably disposed on a rocker shaft (not shown). In the case of the first rocker 204, the half-rocker comprises a suitable follower 302 (a roller follower is illustrated in FIG. 4) configured to receive valve actuation motions from a valve actuation motion source in the form of cams residing on a camshaft (not shown), as known in the art. As best shown in FIG. 3, the second rocker arm 206 is U-shaped and comprises two arms 304, 306 each having a rocker shaft opening 216 (only one shown) for receiving a rocker shaft. The arms 304, 306 are joined together at their distal ends (relative to their respective rocker shaft openings) by a cross member 308 such that the arms 304, 306 are constrained to move in unison. As shown, the arms 304, 306 of the second rocker 206 are spaced apart from each to provide sufficient space for the first rocker arm 204 to fit therebetween. A portion 204*a* of the first rocker arm 204 defines a similar rocker shaft opening (not shown). The second rocker arm 206 comprises a contact boss 218 that provides, as best shown in FIG. 4, a collapsing mechanism contact surface 404, operation of which is described in further detail below. Similarly, a pair of engine valve bosses 210, 212 are provided in the second rocker arm 206, which bosses 210, 212 are configured to align with a pair of engine valves (not shown). Swivels 211, 213 may extend downwardly from the corresponding engine valve bosses 210, 212 for contact with the engine valves. In an embodiment, each of the valve bosses 210, 212 may comprise a hydraulic lash adjuster, as known in the art. In this case, the second rocker arm 206 will include hydraulic passages for providing a continuous supply of hydraulic fluid to the hydraulic lash adjusters.

As best shown in FIG. 4, the first rocker arm 204 comprises a collapsing mechanism 402 disposed within a bore 401 formed in the first rocker arm 204, which collapsing mechanism 402 establishes contact with the collapsing mechanism contact surface 404. In particular, the collapsing mechanism 402 illustrated in FIG. 4 is a hydraulically-actuated locking mechanism comprising a housing 410 disposed in the bore 401. The housing 410 is fixedly retained in the housing bore 401, for example, through a threaded engagement, interference fit or slip fit with a retaining ring between the housing 410 and housing bore 401. Although the housing 410 is provided in the illustrated embodiment, it is understood that the features of the housing 410 described herein could be provided directly in the body of the third rocker arm 700. Regardless, in turn, the housing 410 comprises a bore 411 having an outer plunger 412 slidably disposed therein. An end of the outer plunger 412 extending out of the bore 401 is terminated by a cap 422 having a ball 422 and swivel 424, which collectively establish contact with the collapsing mechanism contact surface 404 as shown. The outer plunger 412 also has a bore 413 with an inner plunger 414 slidably disposed therein. In the illustrated embodiment, a locking spring 420 biases the inner plunger 414 into the outer plunger bore 413. So long as the biasing force provided by the locking spring 420 is unopposed, the inner plunger 414 is biased into the outer plunger bore 413 thereby causing locking elements 416 to extend through openings formed in sidewalls of the outer plunger 412. As further shown, the housing 410 has an outer recess 418 formed in an inner wall thereof. When the locking elements 416 are extended and aligned with the outer recess 418, the outer plunger 412 is mechanically prevented from sliding within the housing bore 411, i.e., it is locked relative to the housing 410, such that the outer plunger 412 is maintained in an extended position regardless of any valve actuation motions applied to the first rocker arm 204. Consequently, any valve actuation motions applied to first rocker arm 204 are conveyed via the collapsing mechanism 402 and collapsing mechanism contact surface 404 to the second rocker arm 206, i.e., the collapsing mechanism is operated in the first collapsing mechanism state.

The housing 410 also comprises an annular channel 430 formed on an outer sidewall surface thereof and radial openings 432 extending through the sidewall thereof that may receive hydraulic fluid from passages (not shown) formed in the first rocker arm 204. The hydraulic fluid thus supplied may be further routed into the outer plunger bore 413 (via openings in the outer plunger 413 not shown) such that the pressure applied by the hydraulic fluid counteracts the bias provided bias provided by the locking spring 420 and further causes the inner plunger 414 to slide out of the outer plunger bore 413. As it does so, a reduced-diameter portion of the inner plunger 414 aligns with the locking elements 416, thereby permitting the locking elements 416 to retract and disengage with the outer recess 418. In this state, the outer plunger 412 is permitted to slide further into the housing bore 411, i.e., it is unlocked. Consequently, any valve actuation motions applied to first rocker arm 204 are not conveyed via the collapsing mechanism 402 to the second rocker arm 206 to the extent that such motions simply cause the outer plunger 412 to reciprocate within the housing bore 410, i.e., the collapsing mechanism is operated in the second collapsing mechanism state.

As noted above, hydraulic lash adjusters may be provided in the systems described herein. In an embodiment, a travel limiter may be provided to limit a bias applied by the collapsing mechanism 402, when in the second collapsing mechanism state (i.e., unlocked), on the hydraulic lash adjuster(s). An example of the use of a hydraulic lash adjuster and travel limiter is described in further detail below relative to FIG. 10. However, it is understood that the principles described therein may be equally applied to any of the embodiments described therein.

As further shown in FIGS. 2-4, a resilient element 214 (such as a compression spring, as shown) may be provided between the first and second rockers 204, 206. As best shown in FIG. 4, the resilient element 214 is disposed about the outer plunger 412, cap 422, ball 422 and swivel 424 and further abuts the first rocker arm 204 at one end and the second rocker arm 206 at its other end. In this embodiment, the end of the resilient element 214 abuts the second rocker arm 206 at the collapsing mechanism contact surface 404, though those skilled in the art will appreciate that this is not a requirement. Thus configured, the resilient element 214 biases the first rocker arm 204 away from second rocker arm 206 and into contact with the motion source.

Once again, it is noted the deployment of the collapsing mechanism 402 and the corresponding collapsing mechanism contact surface 404 could be reversed from the configuration illustrated in FIGS. 2-4, i.e., the collapsing mechanism 402 could be provided in the second rocker arm 206 and the collapsing mechanism contact surface 404 provided in first rocker arm 204.

Figure 5:
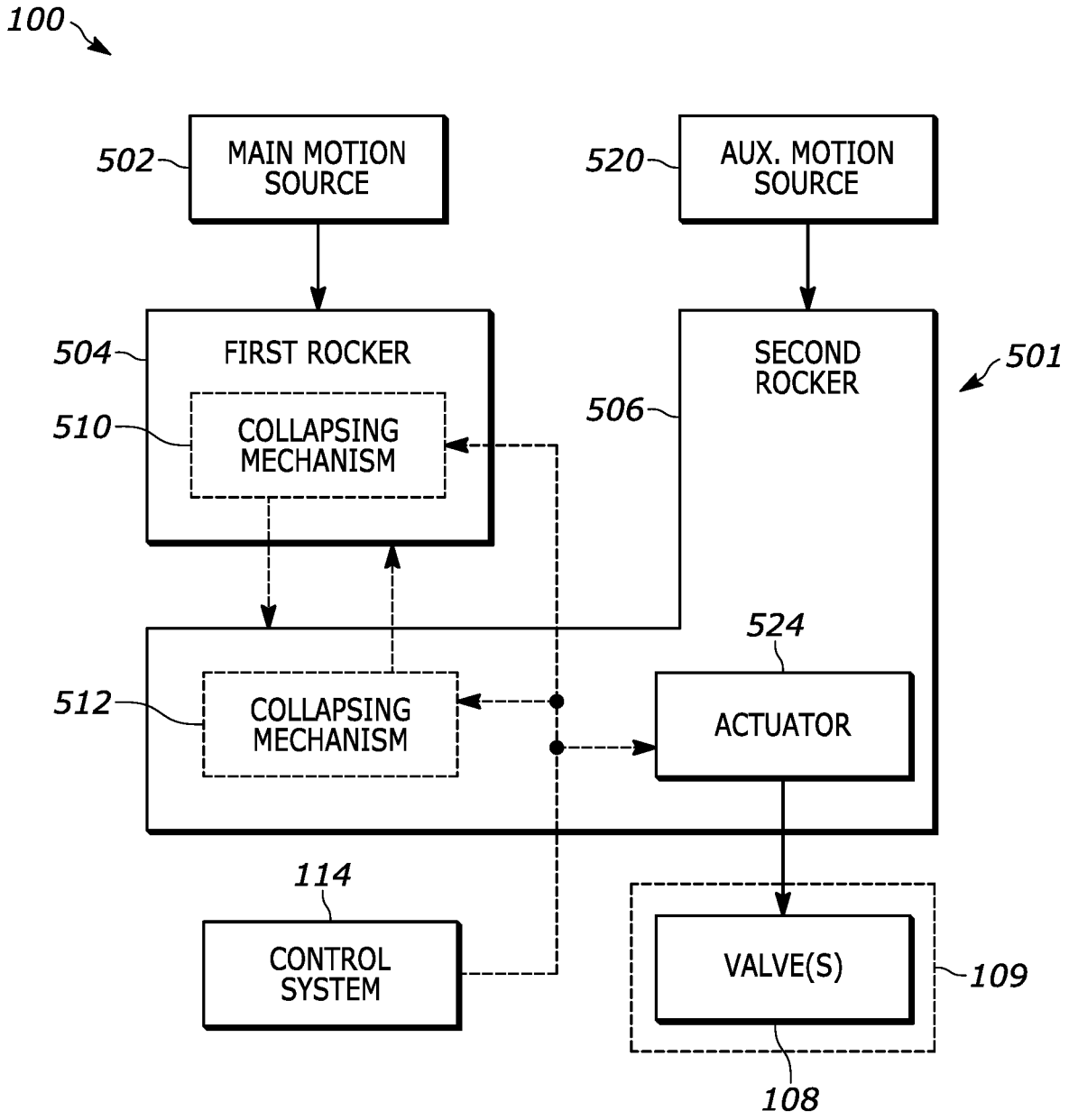
FIG. 5 is a schematic illustration of a valve actuation system in accordance with a second embodiment of the instant disclosure.
Figure 6:
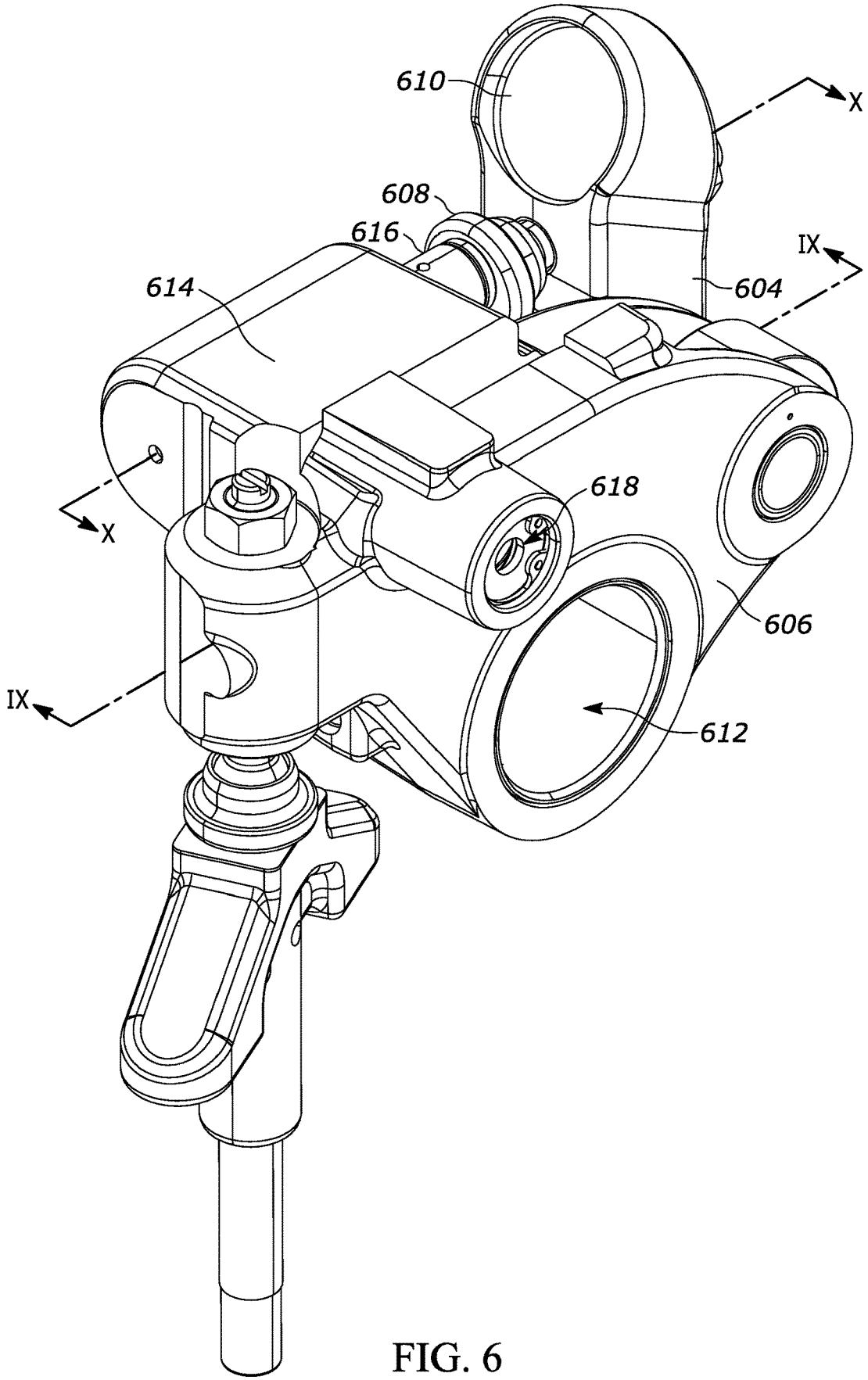
FIG. 6 is a top right isometric view of an example of a valve actuation system in accordance with the embodiment of FIG. 5.

Referring now to the second embodiment schematically illustrated in FIG. 5, a system 501 comprises a first rocker arm 504 and a second rocker arm 506. In this case, the first rocker arm 504 is once again a half-rocker arm configured to receive valve actuation motions from a main valve actuation motion source 502. As used herein, the descriptor "main" refers to valve actuation motions that are used during a positive power generation state of operation of the engine. On the other hand, the second rocker arm 506 is configured to receive valve actuation motions from an auxiliary valve actuation motion source 520 and is further configured to convey main and/or auxiliary valve actuation motions to one or more engine valves 108. As used herein, the descriptor "auxiliary" refers to valve actuation motions that are used during a state of engine operation that is in addition to or in place of positive power generation, e.g., for various types of engine braking, late intake valve closing (LIVC), early exhaust valve opening (EEVO), etc. As in the case of the first embodiment illustrated in FIG. 1, a collapsing mechanism 510, 512 of the type described above is provided in either the first rocker arm 504 or the second rocker arm 506 (it being preferred, in this embodiment, to deploy the collapsing mechanism 512 in the second rocker arm 506). Further, in this second embodiment, the second rocker arm 506 is optionally provided with an actuator 524, for example, a hydraulically-activated actuator that may be selectively controlled to extend out of, or retract into, the second rocker arm 506. As in the case of FIG. 1, the collapsing mechanism 510, 512 may be controlled to couple/decouple the main and second rocker arms 504, 506, i.e., to operate in first and second collapsing mechanism states as described above, using a control system 114. The actuator 524 may likewise be controlled by the control system 114 to transfer valve actuation motions received from the auxiliary valve actuation motion source 520 to the valves 108, or to prevent transmission of such motions (i.e., to lose them).

Through the selective operation of the collapsing mechanism 510, 512 and the actuator 524, the system illustrated in FIG. 5 may be used to support a number of different engine operating modes. In a first state, where the both the collapsing mechanism 510, 512 and the actuator 524 are not activated (or are not in an "on" state), valve actuation motions from neither the main motion source 502 nor the auxiliary motion source 520 will be conveyed to the engine valve(s) 108, thereby effectively deactivating the corresponding cylinder 109. In a second state, where the collapsing mechanism 510, 512 is activated but the actuator 524 is not activated, only valve actuation motions from the main motion source 502 are conveyed to the valve(s) 108 as would be the case during typical positive power operation. In a third state, where the collapsing mechanism 510, 512 is not activated but the actuator 524 is activated, only valve actuation motions from the auxiliary motion source 520 are conveyed to the valve(s) 108 as would be the case, for example, during HPD engine braking operation or a lower lift main valve actuation event for early or late main event closing. In a fourth state, where the collapsing mechanism 510, 512 is activated and the actuator 524 is activated, valve actuation motions from both the main motion source 502 and the auxiliary motion source 520 are conveyed to the valve(s) 108 as would be the case, for example, in conventional (non-HPD) compression release engine braking, LIVC or EEVO. Additionally, this fourth state of operation may also be desirable when transitioning between engine operating states, e.g., between positive power operation and engine braking operation (or other auxiliary operation) and vice versa, as further described below.

Figure 7:
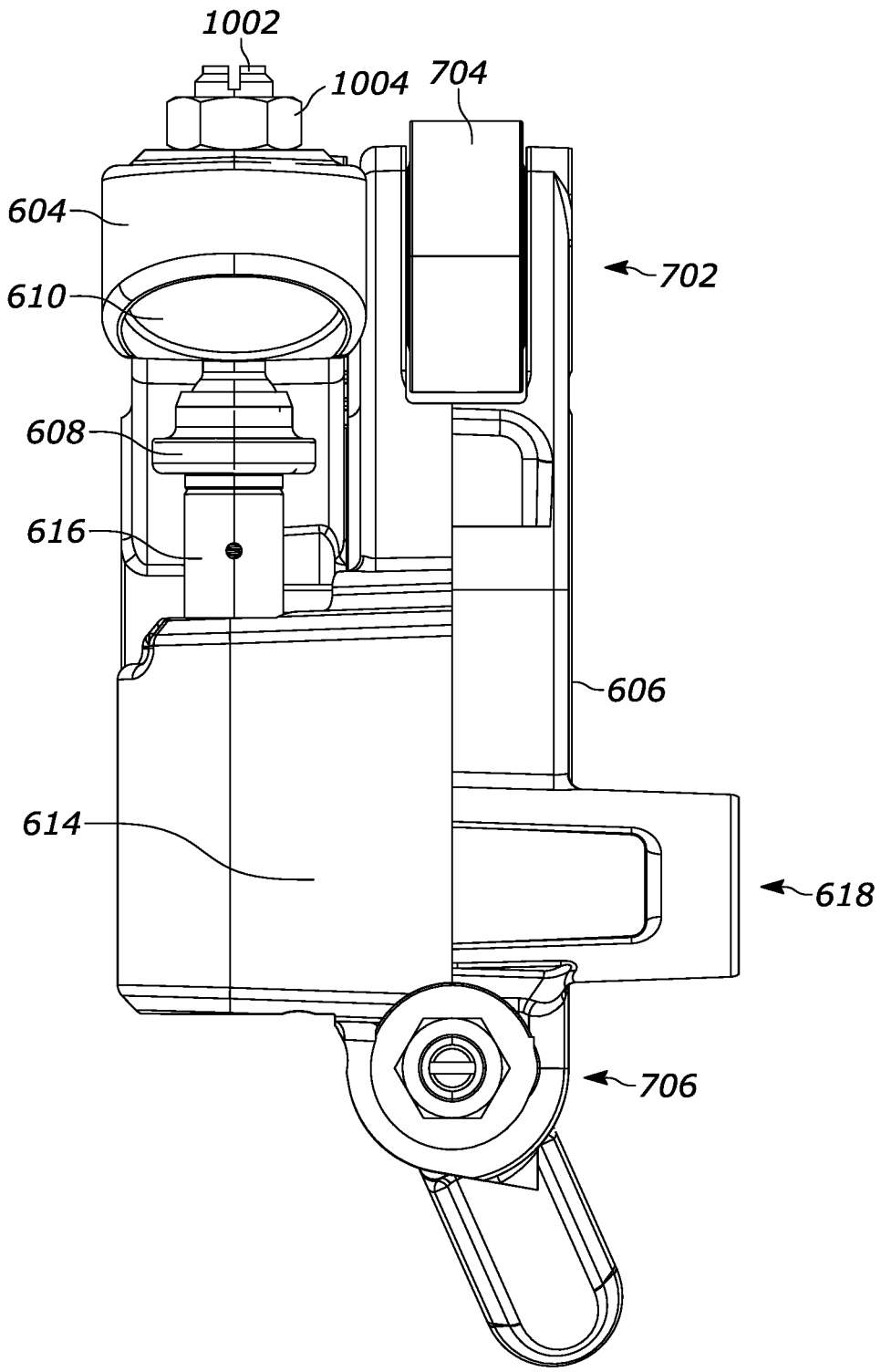
FIG. 7 is a top view of an example of a valve actuation system in accordance with the embodiment of FIG. 5.
Figure 8:
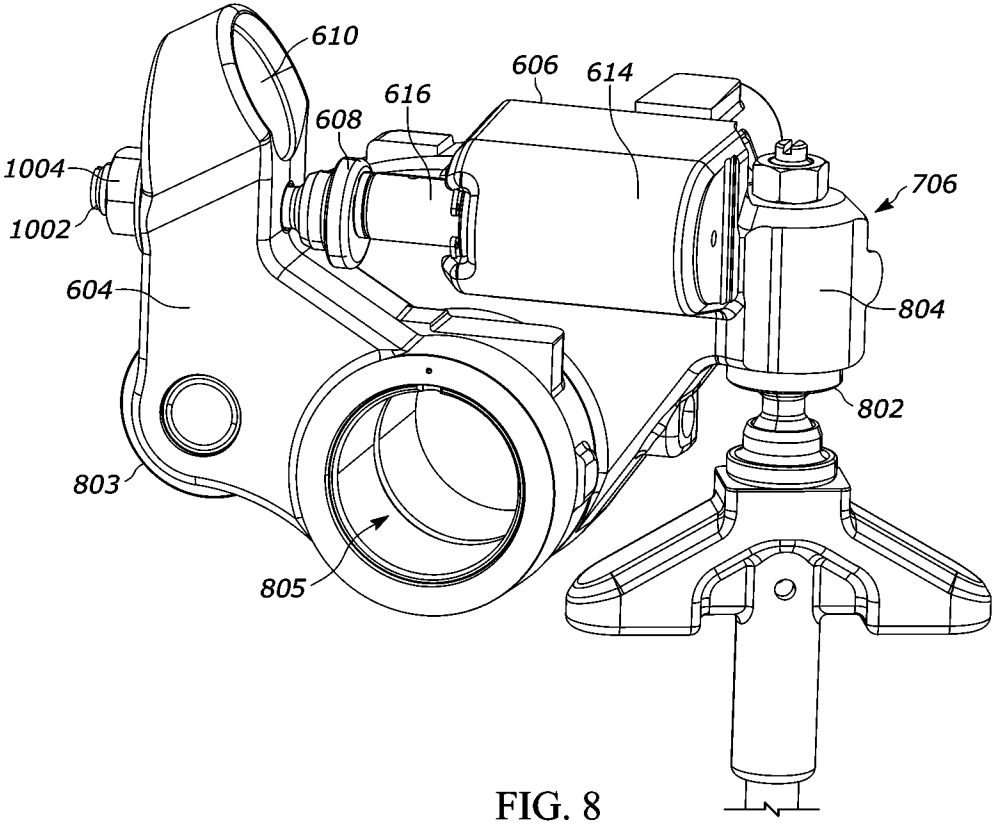
FIG. 8 is a top left isometric view of an example of a valve actuation system in accordance with the embodiment of FIG. 5.
Figure 9:
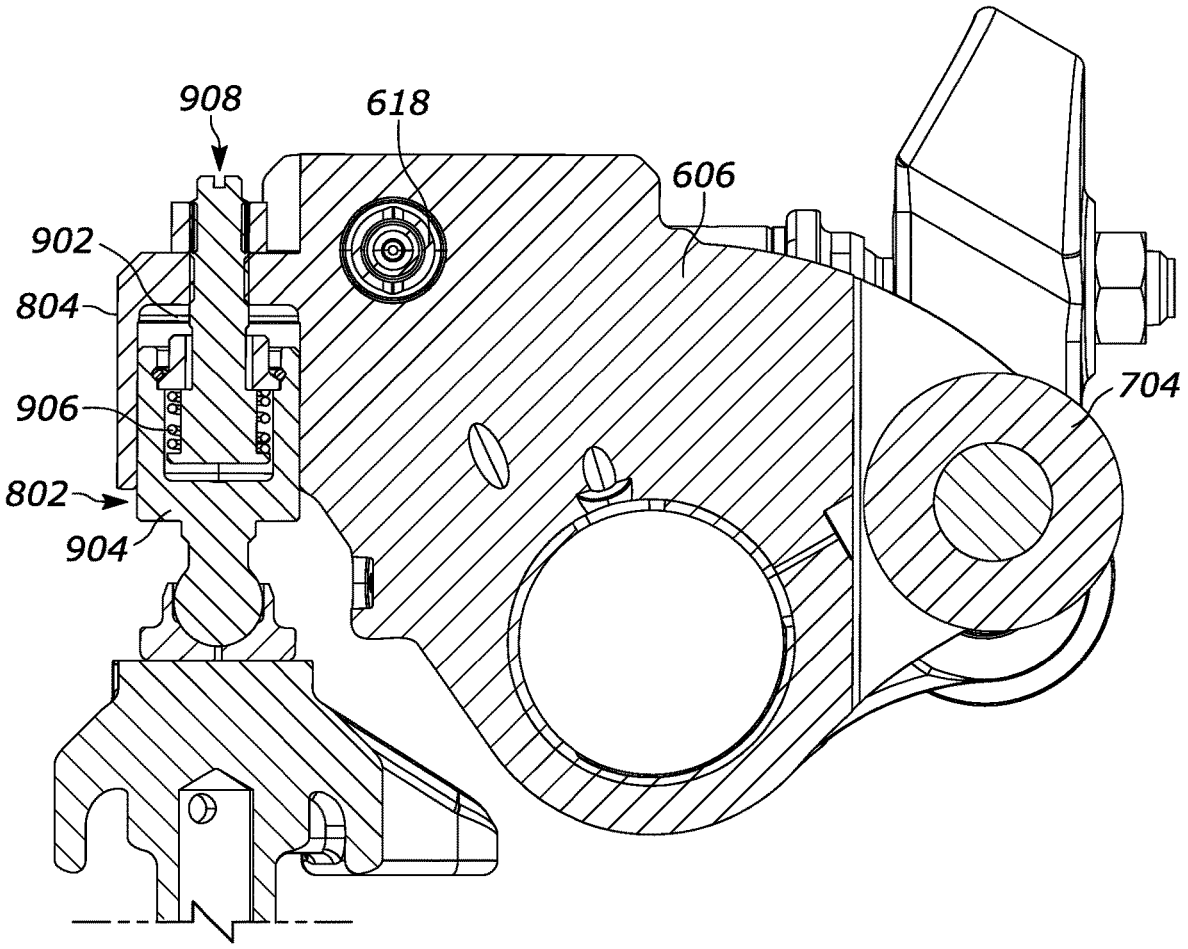
FIG. 9 is a right cross-sectional side view take along section line IX-IX in FIG. 6 of an example of a valve actuation system in accordance with the embodiment of FIG. 5.
Figure 10:
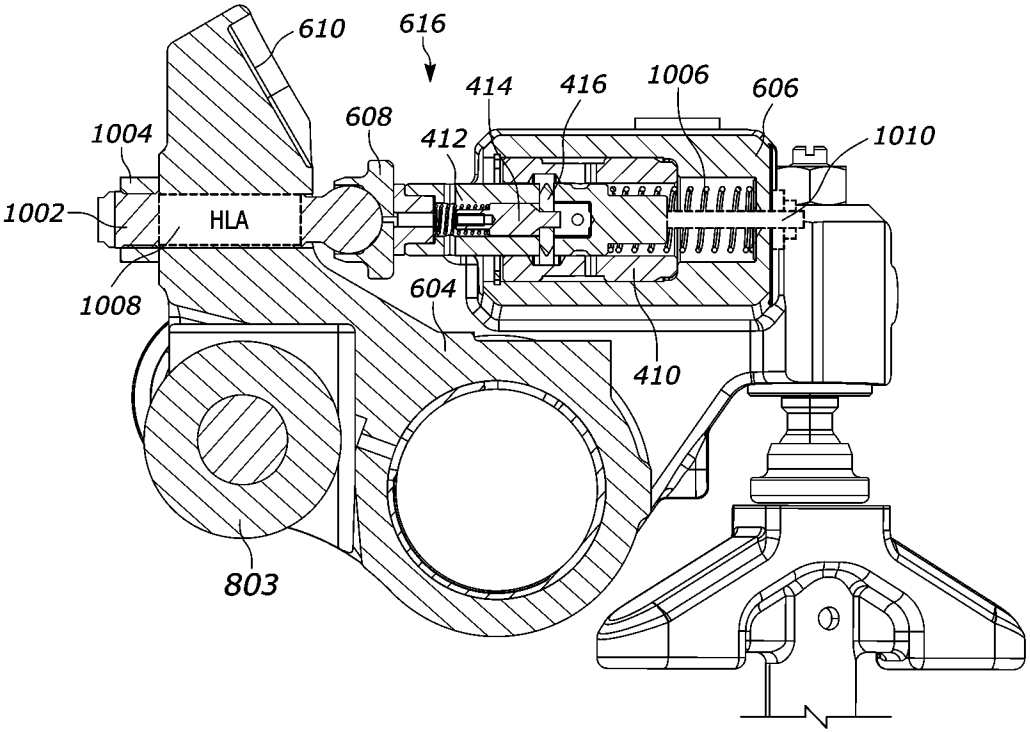
FIG. 10 is a left cross-sectional side view take along section line X-X in FIG. 6 of an example of a valve actuation system in accordance with the embodiment of FIG. 5.

An example of an embodiment in accordance with the system 501 of FIG. 5 is illustrated with further reference to FIGS. 6-10. As shown, the system comprises a first rocker arm 604 and an second rocker arm 606 configured for rotatable mounting on a rocker shaft (not shown) via rocker shaft openings 805, 612 formed therein. The first rocker arm 604 is a half-rocker arm and comprises a roller follower 803 (FIGS. 8 and 10) that receives valve actuation motions from a main event valve actuation motion source (e.g., a cam; not shown). The first rocker arm 604 further comprises an adjustable contact surface 608 and a bias spring seat 610 as best shown in FIGS. 8 and 10. As further shown in FIG. 10, the adjustable contact surface 608 (or collapsing mechanism contact surface) comprises a swivel mounted on a bolt 1002 and secured with a locking nut 1004. The bolt 1002, much like a manual lash adjustment bolt as known in the an, may be rotated so as to adjust the distance the adjustable contact surface 608 extends away from the first rocker arm 604. The bias spring seat 610 is configured to receive a resilient element (not shown) that applies a bias force to the first rocker arm 604 thereby urging the first rocker arm 604 into contact with the main valve actuation motion source. In the illustrated embodiment, this resilient element additionally contacts a fixed surface (not shown). However, it is understood that a resilient element similar to that depicted in FIGS. 2-4, i.e., disposed between the first and second rockers 604, 606, could be equally employed.

The second rocker arm 606 has a motion receiving end 702 having a roller follower 704 mounted thereon for receiving valve actuation motions from an auxiliary valve actuation motion source (e.g., a cam; not shown). The auxiliary or braking rocker arm 606 also has a motion imparting end 706 configured to contact one or more engine valves (often through a valve bridge as known in the art).

As best shown in FIGS. 7, 8 and 10, the second rocker arm 606 also includes two hydraulically-actuated components: a collapsing mechanism 616 and an actuator 802. In the illustrated embodiment, the collapsing mechanism 616 resides in a collapsing mechanism boss 614 extending laterally away from the second rocker arm 606 toward the first rocker arm 604. Additionally, the actuator 802 resides in an actuator boss 804 formed in the motion imparting end 706 of the second rocker arm 606. In an embodiment in which the collapsing mechanism 616 and actuator 802 are hydraulically actuated, hydraulic fluid may be provided to the collapsing mechanism 616 and actuator 802 via hydraulic passages (not shown) formed in the second rocker arm 606 and a rocker shaft in accordance with known techniques.

As best shown in FIG. 9, the actuator 802 resides in an bore 902 formed in the actuator boss 804 and comprises an actuator piston 904 slidably disposed in the actuator bore 902. As shown, a manual lash adjustment assembly 908 is provided in the bore 902 and the actuator piston 904 is biased into the bore 902 by an actuator bias spring 906 interposed between the lash adjustment assembly 908 and the actuator piston 904. Additionally, a control valve 618 is provided in the second rocker arm 606. As known in the art, hydraulic fluid may be routed to the actuator bore 902 via the control valve 618 and hydraulic passages (not shown) in the second rocker arm 606. When hydraulic pressure is applied to the bore 902 via the control valve 618, the actuator piston 906 extends from the bore 902 and is rigidly maintained in this extended position (i.e., a first actuator state) by virtue of a locked volume of hydraulic fluid provided by a control valve 618, as known in the art. On the other hand, the absence of hydraulic pressure applied to the control valve 618 (and, consequently, the bore 902) releases the locked hydraulic fluid thereby permitting the actuator piston 904 to slide freely within the bore 902 (i.e., a second actuator state).

As best illustrated in FIG. 10, the collapsing mechanism 616 may comprise a hydraulically-actuated locking mechanism substantially similar to the type described above (relative to FIG. 4) where the collapsing mechanism 616 comprises one or more locking elements 416 that may be controlled through operation of an inner plunger 414 to lock an outer plunger 412 in place, e.g., in an extended position, relative to a housing 410 such that the collapsing mechanism rigidly contacts the adjustable contact surface 608 of the first rocker arm 604. On the other hand, as before, the locking elements 416 may be retracted such that that outer plunger 412 is permitted to slide freely within the housing bore while still contacting the adjustable contact surface 608 by virtue of bias provided by, in this case, an outer plunger bias spring 1006.

In an embodiment, the collapsing mechanism 616, when maintained in a locked state such as during positive power operation of the engine, permits the second rocker arm 606 to receive motions from the first rocker arm 604 by virtue of contact between the collapsing mechanism 616 and the adjustable contact surface 608. In contrast, when maintained in an unlocked state such as during auxiliary or engine braking operation of the engine, the collapsing mechanism 616 absorbs any valve actuation motions provided by the first rocker arm 604, thereby preventing such motions from being passed to the second rocker arm 606 and onto the engine valves.

FIG. 10 further illustrates the use of an optional hydraulic lash adjuster 1008 and travel limiter 1010 to ensure proper operation of the hydraulic lash adjuster 1008 in cooperation with the collapsing mechanism 616. In this example, the hydraulic lash adjuster 1008 is disposed in the first rocker arm 604 where the bolt 1002 is disposed. In this case, the bolt 1002 would not be required for lash adjustment given the presence of the hydraulic lash adjuster 1008. When operated in the collapsing mechanism second state (i.e., unlocked), the bias provided by the outer plunger bias spring 1006 would continuously urge the outer plunger 412 against the hydraulic lash adjuster 1008, which would eventually cause the hydraulic lash adjuster 1008 to fully collapse. In order to prevent this from occurring, which still permitting the outer plunger 412 to absorb valve actuation motions when the collapsing mechanism is in the collapsing mechanism second state, a travel limiter 1010 may be provided to ensure that the outer plunger 412 is not free to continuously provide a counterforce against the hydraulic lash adjuster 1008. Thus, in the illustrated example, the outer plunger 412 is equipped with the illustrated travel limiter 1010 as shown. When the outer plunger 412 is able to freely reciprocate, its travel out of the housing bore (i.e., leftward in the illustration of FIG. 10) is limited by the travel limiter 1010, which includes a washer/nut assembly configured to abut an outer surface of the second rocker arm 606. In this manner, the outer plunger bias spring 1006 is prevented from causing a collapse of the hydraulic lash adjuster 1008, which would defeat its purpose. Additionally, when the collapsing mechanism is in the collapsing mechanism first state (i.e., locked), the maximum travel distance of the outer plunger 412 is selected such that the locking elements 416 are positioned with lash space on either side thereof within the housing recess. In this manner, any frictional load on the locking elements 416 with the sidewalls of the housing recess is minimized or eliminated entirely, thereby facilitating retraction of the locking elements 416 when the collapsing mechanism 616 is switched to the collapsing mechanism second state.

Additionally, during positive power operation of the engine, the actuator 802 is maintained in the second actuator state such that lash space is permitted to develop between the roller follower 704 of the second rocker arm 606 and the auxiliary valve actuation motion source, and thereby preventing any auxiliary valve actuation motions from being passed to the engine valves. On the other hand, during auxiliary operation of the engine, the actuator 802 is maintained in the first actuator state, thereby taking up the lash between the roller follower 704 and the auxiliary valve actuation motion source such that auxiliary valve actuation motions are passed through the second rocker arm 606 to the engine valves (while the main event motions may be simultaneously lost or not, as the case may be, via the collapsing mechanism 616, as described above).

An aspect of the system illustrated in FIGS. 6-10 is the potential for intake counterflow to develop during transitions between positive power operation and engine braking operation (or other auxiliary operation) of the engine, and vice versa. For example, during engine braking turn on (i.e., a transition from positive power generation to engine braking operation), it is possible for the collapsing mechanism 616 to switch to its unlocked or collapsed stated before the actuator 802 has fully extended, meaning that main event valve actuation motions are lost before engine braking valve actuation motions can be applied to engine valves with the further result that the exhaust valves are not opened during this time. This inability to open the exhaust valves during the transition leads to an intake rocker arm opening up against higher cylinder pressures. These high pressures can then counterflow into an intake manifold and back up to a compressor wheel of a turbocharger, which leads to potentially undesirable turbo surge.

One approach to avoid the above-noted issue with transition between positive power operation and engine braking operation is to sequence control of the actuator 802 and collapsing mechanism 616. Thus, in an embodiment, the actuator 802 and collapsing mechanism 616 are controlled (via a control system 114 as illustrated in FIG. 5) such that the actuator 802 is transitioned from the second actuator state (i.e., not conveying auxiliary valve actuation motions) to the first actuation state (i.e., conveying auxiliary valve actuation motions) prior to transitioning the collapsing mechanism 616 from the first collapsing mechanism state (i.e., conveying main valve actuation motions) to the second collapsing mechanism state (i.e., conveying main valve actuation motions). In this manner, both the main and auxiliary valve actuation motions are conveyed to the engine valves during the transition while the actuator 802 is in the first actuator state and the collapsing mechanism 616 is in the first collapsing mechanism state. Thereafter, the collapsing mechanism 616 is controlled to operate in the second collapsing mechanism state, thereby causing the main valve actuation motions to be lost.

Figure 11:
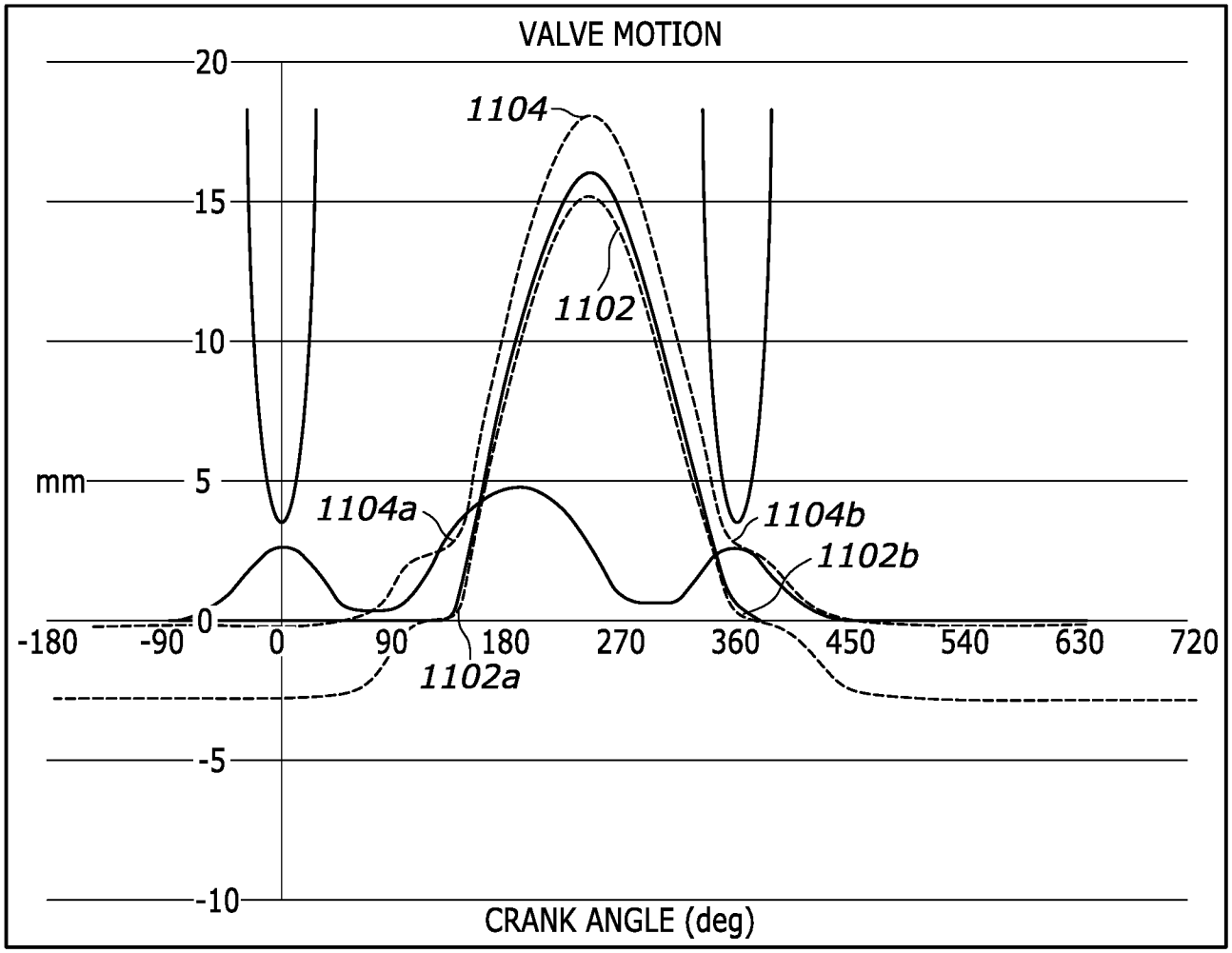
FIG. 11 illustrates exhaust valve motions for a main valve actuation motion source in accordance with the instant disclosure.

During positive power operation, main events 1102 of the type illustrated in FIG. 11 (lower dashed curve) include so-called ramps 1102*a-b* at a base circle level of a cam that control velocity (particularly seating velocity) of the engine valves at the beginning and end of the main valve event 1102. On the other hand, as described above, it is desirable to delay deactivation of the collapsing mechanism 616 (i.e., thereby causing it to absorb motions rather than convey them) in order to provide sufficient time for complete activation of the actuator 802 (i.e., to permit it to fully extend) when transitioning from positive power generation to engine braking. However, during such transitions, at least a portion of a valve lift profile like the upper dashed curve 1104 illustrated in FIG. 8 may be presented to the engine valves by virtue of the fact that both the collapsing mechanism and actuator may be in their extended (i.e., motion-conveying states) for a period of time. In order to prevent uncontrolled valve velocities, additional ramps 1104*a-b* are provided at a sub-base circle level prior to a beginning ramp 1102*a* and subsequent to an ending ramp 1102*b*, as shown. In this manner, opening and closing velocities of the engine valve(s) are ensured to proceed in a controlled manner during transitions of the collapsing mechanism and actuator as described above. Additionally, the sub-base circle provided may be configured to permit simultaneous operation of the collapsing mechanism in the first collapsing mechanism state and the actuator in the first actuator state, i.e., both fully extended.

While particular preferred embodiments have been shown and described, those skilled in the art will appreciate that changes and modifications may be made without departing from the instant teachings. It is therefore contemplated that any and all modifications, variations or equivalents of the above-described teachings fall within the scope of the basic underlying principles disclosed above and claimed herein. For example, though a particular implementation of the collapsing mechanism is described above, it is understood that other types of collapsing mechanisms could be employed. Furthermore, the embodiments of FIGS. 5-10 all illustrate the actuator 802 being disposed in the motion imparting end 706 of the second rocker arm 606. However, this is not a requirement and the actuator could be implemented in the form of an actuated follower, e.g., a roller follower deployed on a piston that can be extended and retracted in a similar manner. Further still, in each of the above-described embodiments, the rocker arms are configured to be pivotable around a fixed rocker shaft. However, it is understood that the two rockers can be configured to pivot relative to each other. For example, a pivot may be provided on a first of the rocker arms such that the second rocker arm is attached to and pivotable about the pivot provided by the first rocker arm, and such that the collapsing mechanism is still able to absorb valve actuation motions as described above.

What is claimed is:

1. A system for actuating at least one engine valve associated with a cylinder of an internal combustion engine, comprising:

a first half-rocker arm rotatably mounted on a rocker shaft and configured to receive main valve actuation motions from a main valve actuation motion source comprising a first cam;

a second rocker arm rotatably mounted on the rocker shaft configured to actuate the at least one engine valve; and a hydraulically-controlled collapsing mechanism comprising a plunger slidably disposed in a bore and a mechanical locking mechanism, the collapsing mechanism configured relative to the first half-rocker arm and the second rocker arm, in a first collapsing mechanism state, to convey the main valve actuation motions from the first half-rocker arm to the second rocker arm and, in a second collapsing mechanism state, to prevent conveyance of the main valve actuation motions from the first half-rocker arm to the second rocker arm, wherein the mechanical locking mechanism prevents the plunger from sliding in the bore and maintains the plunger in an extending position during the first collapsing mechanism state and permits the plunger to reciprocate in the bore during the second collapsing mechanism state, and wherein either the first half-rocker arm or the second rocker arm comprises a hydraulic passage in communication with the collapsing mechanism.

2. The system of claim 1, further comprising an engine control unit configured to transition the collapsing mechanism from the first collapsing mechanism state to the second collapsing mechanism state and vice versa.

3. The system of claim 1, wherein the collapsing mechanism is disposed in the first-half rocker arm.

4. The system of claim 3, the second rocker arm comprising a collapsing mechanism contact surface.

5. The system of claim 1, wherein the collapsing mechanism is disposed in the second rocker arm.

6. The system of claim 1, the first half-rocker arm comprising resilient element contact surface configured to cooperatively engage with a resilient element for biasing the first half-rocker arm into contact with the main valve actuation motion source.

7. The system of claim 1, wherein either of the first half-rocker arm or the second rocker arm comprises a hydraulic lash adjuster.

8. The system of claim 7, further comprising a travel limiter configured to limit a bias force applied by the collapsing mechanism on the hydraulic lash adjuster.

9. The system of claim 1, wherein the second rocker arm is a second half-rocker arm.

10. The system of claim 9, further comprising a resilient element, disposed between the first half-rocker arm and the second rocker arm to bias the first half-rocker arm into contact with the main valve actuation motion source.

11. The system of claim 1, wherein the second rocker arm is configured to receive auxiliary valve actuation motions from an auxiliary valve actuation motion source comprising a second cam.

12. The system of claim 11, the second rocker arm comprising a hydraulically-controlled actuator configured relative to the second rocker arm and the at least one engine valve, in a first actuator state, to convey the auxiliary valve actuation motions from the second rocker arm to the at least one engine valve and, in a second actuator state, to prevent conveyance of the auxiliary valve actuation motions from the second rocker arm to the at least one engine valve.

13. The system of claim 12, wherein the first cam has at least a sub-base circle closing ramp configured to control closing velocity of the at least one engine valve when the collapsing mechanism is operating in the first collapsing mechanism state and the hydraulically-controlled actuator is operating in the first actuator state.

14. The system of claim 12, wherein the first cam has at least a sub-base circle configured to allow extension of the hydraulically-controlled actuator while the collapsing mechanism is in the first collapsing mechanism state such that the second rocker arm simultaneously conveys the main valve actuation motions and the auxiliary valve actuation motions.

15. The system of claim 12, further comprising an engine control unit configured to transition the hydraulically-controlled actuator from the second actuator state to the first actuator state prior to transitioning the collapsing mechanism from the first collapsing mechanism state to the second collapsing mechanism state.

* * * * *